US010589153B2

(12) United States Patent
Towell

(10) Patent No.: US 10,589,153 B2
(45) Date of Patent: Mar. 17, 2020

(54) ADJUSTABLE GOLF CLUB

(71) Applicant: David Towell, Fort Myers, FL (US)

(72) Inventor: David Towell, Fort Myers, FL (US)

( * ) Notice: Subject to any disclaimer, the term of this patent is extended or adjusted under 35 U.S.C. 154(b) by 0 days.

(21) Appl. No.: 16/268,899

(22) Filed: Feb. 6, 2019

(65) Prior Publication Data

US 2019/0240544 A1 Aug. 8, 2019

Related U.S. Application Data

(60) Provisional application No. 62/627,501, filed on Feb. 7, 2018.

(51) Int. Cl.

| | |
|---|---|
| ***A63B 53/06*** | (2015.01) |
| ***A63B 53/02*** | (2015.01) |
| ***A63B 53/04*** | (2015.01) |
| ***A63B 60/48*** | (2015.01) |
| *A63B 71/06* | (2006.01) |
| *A63B 53/10* | (2015.01) |
| *A63B 60/00* | (2015.01) |

(52) U.S. Cl.

CPC ..... *A63B 53/02* (2013.01); *A63B 53/047* (2013.01); *A63B 53/06* (2013.01); *A63B 60/48* (2015.10); *A63B 53/10* (2013.01); *A63B 2053/022* (2013.01); *A63B 2053/023* (2013.01); *A63B 2053/025* (2013.01); *A63B 2053/026* (2013.01); *A63B 2060/0085* (2015.10); *A63B 2071/0694* (2013.01); *A63B 2210/50* (2013.01)

(58) Field of Classification Search

CPC ..... A63B 2053/026
USPC ..... 473/316, 305, 307
See application file for complete search history.

(56) References Cited

U.S. PATENT DOCUMENTS

| | | | | | |
|---|---|---|---|---|---|
| 1,549,265 | A * | 8/1925 | Kaden | A63B 53/06 | 473/245 |
| 1,556,928 | A * | 10/1925 | Ganders | A63B 53/06 | 473/245 |
| 1,568,485 | A * | 1/1926 | Turney | A63B 53/06 | 473/247 |
| 1,594,850 | A * | 8/1926 | Perkins | A63B 53/06 | 473/247 |
| 1,621,897 | A * | 3/1927 | Perkins | A63B 53/06 | 473/247 |
| 1,879,117 | A * | 9/1932 | Davidson | A63B 53/06 | 473/247 |
| 1,946,134 | A * | 2/1934 | Dyce | A63B 53/02 | 473/307 |

(Continued)

*Primary Examiner* — Eugene L Kim
*Assistant Examiner* — Matthew B Stanczak
(74) *Attorney, Agent, or Firm* — Boudwin Intellectual Property; Daniel Boudwin

(57) ABSTRACT

An adjustable golf club. The adjustable golf club has a shaft that can selectively secure to a club head. The shaft includes an elongated member which incorporates a first plurality of splines along the elongated member. A club head is removably secured to the shaft by mating the first plurality of splines of the elongated member with a second plurality of splines in an interior cavity of the club head. The angle of the club head can be adjusted through the selective mating of the first plurality of splines of the elongated member to the second plurality of splines of the head. In one embodiment the shaft is further secured to the club head by a quick release system. In another embodiment the length of the shaft can be selectively adjusted.

8 Claims, 5 Drawing Sheets

(56) References Cited

U.S. PATENT DOCUMENTS 2,091,794 A * 8/1937 Pester ..... A63B 53/06 473/245
2,329,313 A * 9/1943 Winter ..... A63B 53/06 473/247
2,381,636 A * 8/1945 Bancroft ..... A63B 53/06 473/247
2,495,444 A * 1/1950 Chamberlain ..... A63B 53/06 473/247
2,576,866 A * 11/1951 Verderber ..... A63B 60/00 473/247
2,777,694 A * 1/1957 Winter ..... A63B 53/02 473/247
2,882,053 A * 4/1959 Lorthiois ..... A63B 53/06 473/245
3,102,726 A * 9/1963 Barrett ..... A63B 53/007 473/239
3,424,459 A 1/1969 Evancho
3,601,399 A * 8/1971 Agens ..... A63B 53/06 473/247
5,133,553 A * 7/1992 Divnick ..... A63B 53/06 473/245
5,282,619 A * 2/1994 Napolitano ..... A63B 53/10 473/239
5,496,029 A * 3/1996 Heath ..... A63B 53/10 473/296
5,924,937 A * 7/1999 Kuo ..... F16B 7/14 473/296
5,928,087 A * 7/1999 Emberton ..... A63B 53/06 473/245
6,206,788 B1 * 3/2001 Krenzler ..... A63B 53/02 473/245
6,547,673 B2 4/2003 Roark
6,837,800 B2 * 1/2005 Rollinson ..... A63B 53/02 473/244
7,083,529 B2 8/2006 Cackett et al.
7,326,126 B2 2/2008 Holt et al.
7,566,279 B2 * 7/2009 Nakashima ..... A63B 53/02 473/288
8,449,404 B2 5/2013 Thomas et al.
2002/0082104 A1 * 6/2002 Dischler ..... A63B 53/02 473/247
2003/0008723 A1 * 1/2003 Goodman ..... A63B 53/02 473/246
2006/0084520 A1 * 4/2006 Lindner ..... A63B 53/10 473/316
2007/0298901 A1 * 12/2007 Nam ..... A63B 53/02 473/305
2008/0009360 A1 * 1/2008 Purtill ..... A63B 53/00 473/244
2015/0258394 A1 * 9/2015 Franklin ..... A63B 53/047 473/332
2015/0343278 A1 * 12/2015 Franklin ..... A63B 53/02 473/309

* cited by examiner

ADJUSTABLE GOLF CLUB

CROSS REFERENCE TO RELATED APPLICATIONS

This application claims the benefit of U.S. Provisional Application No. 62/627,501 filed on Feb. 7, 2018. The above identified patent application is herein incorporated by reference in its entirety to provide continuity of disclosure.

BACKGROUND OF THE INVENTION

The present invention relates to golf clubs. More particularly, the present invention provides for at least an adjustable golf club which has a shaft and a club head that is removably secured to the shaft by mating the complementary splines in an interior cavity of a club head to splines disposed on the shaft. The angle of the club head can be adjusted by the selective mating of the complementary splines.

Many people enjoy playing golf or going to a driving range to practice their golf swing. A typical set of golf clubs consists of up to 14 golf clubs, with each club specifically tailored to hit a set range of distances due to the angle of the club face. Such golf clubs vary in length due to angle of the club face as well as the size, age and gender of the individual player. Carrying such a large number of golf clubs, all of different lengths and club face shapes and angles, can be quite cumbersome. For most people, carrying a full set of golf clubs without the aid of a bag is not feasible. Even with the aid of a bag to store all the clubs, the weight of a fully loaded golf bag can be quite encumbering. Accordingly, an adjustable golf club that can be utilized in the same manner as a large number of individual golf clubs, thereby lightening the load for a user and eliminating the need for a heavy bag of clubs is desired.

Devices have been disclosed in the known art that relate to golf clubs. These include devices that have been patented and disclosed in patent application publications. However, the devices in the known art have several drawbacks. For example, some such devices have multiple club heads that secure to a shaft, thereby requiring the individual to carry a wide assortment of club heads.

The present invention substantially diverges in design elements from the known art and consequently it is clear that there is a need in the art for an improvement to existing golf clubs. In this regard the present invention substantially fulfills these needs.

SUMMARY OF THE INVENTION

In view of the foregoing disadvantages inherent in the known types of golf clubs now present in the prior art, the present invention provides an adjustable golf club wherein the same can be utilized for providing convenience for the user by allowing the angle of the club head to be changed thereby allowing the user to replicate various golf clubs and heads via a single adjustable golf club. The present adjustable golf club comprises a shaft which includes an elongated member with a first plurality of splines along the elongated member. A club head is removably secured to the shaft by mating the first plurality of splines of the elongated member with a second plurality of splines in an interior cavity of the club head. The angle of the club head can be adjusted by the selective mating of the first plurality of splines of the elongated member to the second plurality of splines of the head.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
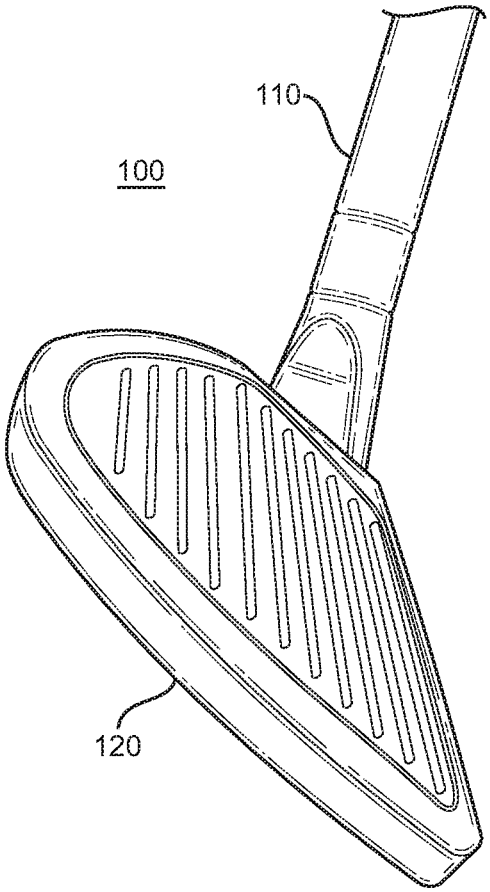
FIG. 1 shows a perspective view of an embodiment of the adjustable golf club.

Reference is made herein to the attached drawings. Like reference numerals are used throughout the drawings to depict like or similar elements of the adjustable golf club. For the purposes of presenting a brief and clear description of the present invention, a preferred embodiment will be discussed as used for the adjustable golf club. The figures are intended for representative purposes only and should not be considered to be limiting in any respect.

Referring now to FIG. 1, there is shown a perspective view of an embodiment of the adjustable golf club. The adjustable golf club 100 has a shaft 110 that can selectively secure to a club head 120. In the shown embodiment the adjustable golf club can replicate any of the set of golf clubs known as "irons" by selectively adjusting the length of the shaft 110 and an angle of the club head 120 relative to the ground. One of ordinary skill in the art will understand that the angle at which the shaft 110 is disposed relative to the ground, where the club head 120 is parallel to the ground, will enable the user to address the golf ball from a standard lie angle and will not require the user to stand over the ball. In various embodiments, the lie angle can be between 50 degrees and 64 degrees. In another embodiment the lie angle can be 60 degrees. Such embodiments provide the benefit of utilizing a pairing of a single shaft with a single club head to replicate a variety of golf clubs. In another embodiment the adjustable golf club can replicate any golf club including but not limited to the set of golf clubs known as "woods" or "wedges" in the same manner. It is contemplated by this disclosure that many different materials can be used for the shaft and club head including, but not limited to: wood, chrome-plated steel, stainless steel, aluminum, carbon or graphite fiber-reinforced epoxy, or titanium.

Figure 2:
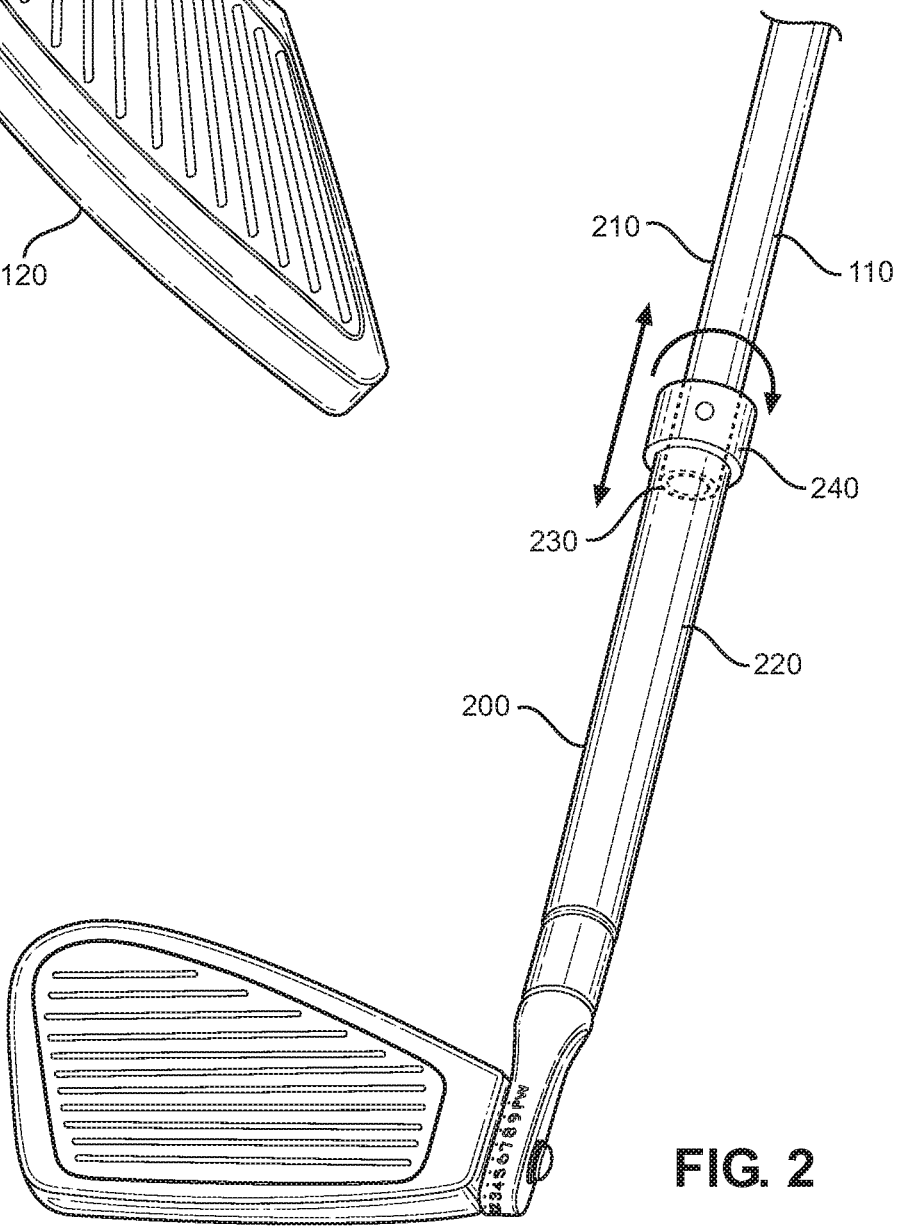
FIG. 2 shows a perspective view of an embodiment of the adjustable golf club in which the length of the shaft can be selectively adjusted.

Referring now to FIG. 2, there is shown a perspective view of an embodiment of the adjustable golf club in which the length of the shaft can be selectively adjusted. In such an embodiment the shaft 110 can be further comprised of a first shaft member 200 and a second shaft member 210. The first shaft member 200 can be configured to receive the second shaft member 210. In the shown embodiment, the first shaft member 200 is comprised of a hollow tube thereby defining an interior diameter 220 of the first shaft member 200. The diameter of the second shaft member 230 is smaller than the internal diameter 220 of the first shaft member 200 thereby allowing the second shaft member 210 to slide inside the internal diameter 220 of the first shaft member 200.

A collar 240 can be disposed along the length of the shaft 110 at a point where the first shaft member 200 and the second shaft member 210 can overlap. The collar 240 can be secured to the first shaft member 200 and the second shaft member 210 in a screw configuration, such that by selectively rotating the collar, the internal diameter 220 of the first shaft member 200 can decrease thereby resulting in a friction fit between the first shaft member 200 and the second shaft member 210. In such a manner the second shaft member 210 can be secured to the first shaft member 200 in a given configuration and length. In such a manner the length of the shaft 110 can be telescopically adjusted.

Figure 3:
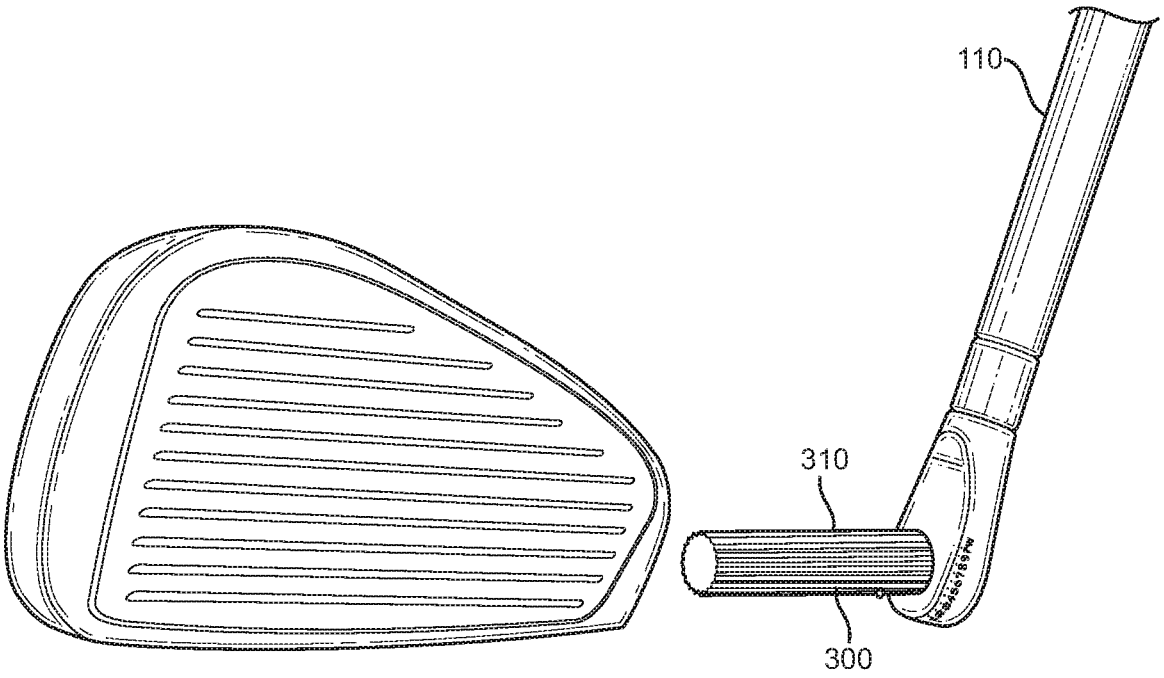
FIG. 3 shows a perspective view of an embodiment of the adjustable golf club with a focus on the first plurality of splines of the shaft.

Referring now to FIG. 3, there is shown a perspective view of an embodiment of the adjustable golf club with a focus on the first plurality of splines of the shaft. An elongated member 310 is disposed orthogonal to the shaft 110. The elongated member 310 further comprises the first plurality of splines 300. The first plurality of splines 300 are disposed around the exterior surface of the elongated member 310.

Figure 4:
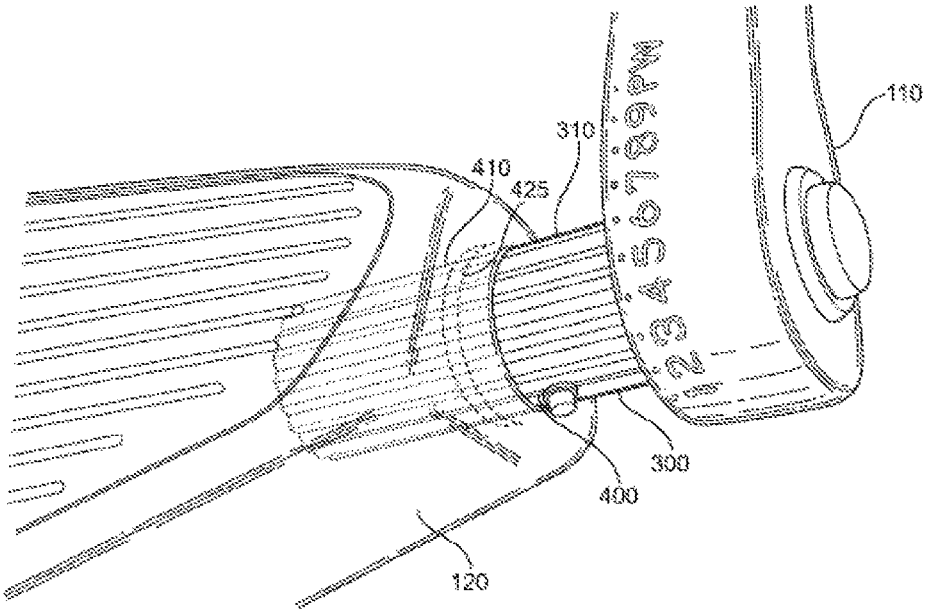
FIG. 4 shows a perspective view of an embodiment of the adjustable golf club with a focus on the first plurality of splines mating with the second plurality of splines.

Referring now to FIG. 4, there is shown a perspective view of an embodiment of the adjustable golf club with a focus on the first plurality of splines mating with the second plurality of splines. A club head 120 is removably secured to the shaft 110 by mating the first plurality of splines 300 of the elongated member 310 with the second plurality of splines 400 disposed in an interior cavity 410 of the club head 120. In the shown embodiment, the interior cavity 410 of the club head 120 is of sufficient diameter to receive the elongated member 310. The second plurality of splines 400 disposed in the interior cavity 410 of the club head 120 are configured to mate with the first plurality of splines 300 of the elongated member 310. In such a manner the shaft 110 can removably secure to the club head 120 in a stable configuration which reduces the possibility of the elongated member 310 sliding in the interior cavity 410. Such a mating of splines provides stability and support when the adjustable golf club 100 is used to strike a golf ball.

Figure 5:
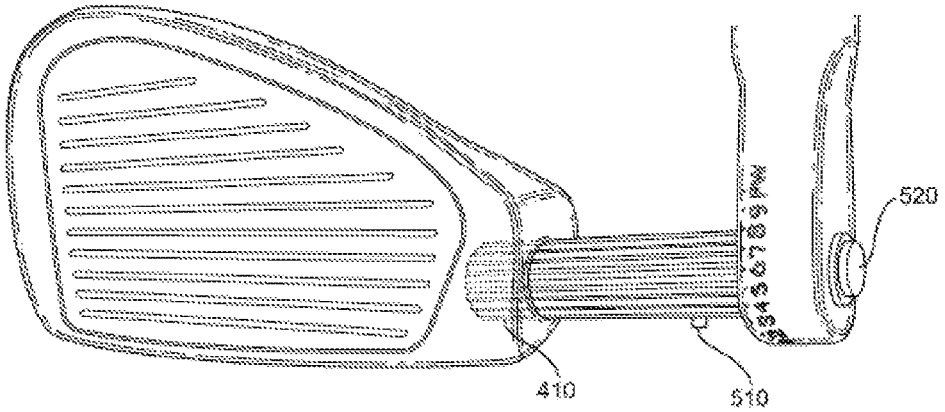
FIG. 5 shows a perspective view of an embodiment of the adjustable golf club.

Referring now to FIG. 4 and FIG. 5, there is shown a perspective view of an embodiment of the adjustable golf club. In the shown embodiment the adjustable golf club can include a quick release system for mating the club head with the elongated member. In such an embodiment a channel 425 is disposed on an interior surface of the interior cavity 410 of the club head. Further, a pin 510 is disposed on the elongated member of the shaft. The channel 425 is configured to receive the pin 510. A quick release button 520 is disposed on the shaft, configured to retract the pin 510 upon depression of the quick release button 520. In such a manner the elongated member can be secured by the mating of the pin 510 in the channel 425, and the elongated member can be released upon depression of the quick release button 520.

Figure 6:
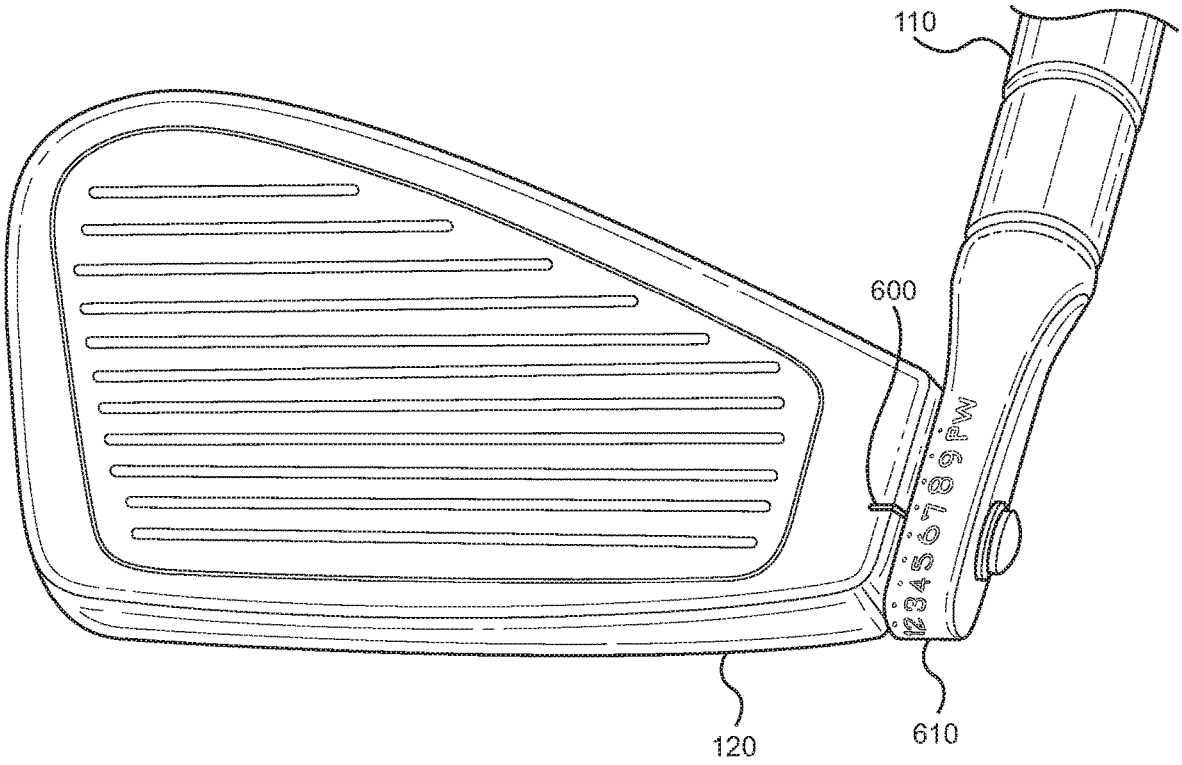
FIG. 6 shows a perspective view of an embodiment of the adjustable golf club.
Figure 7:
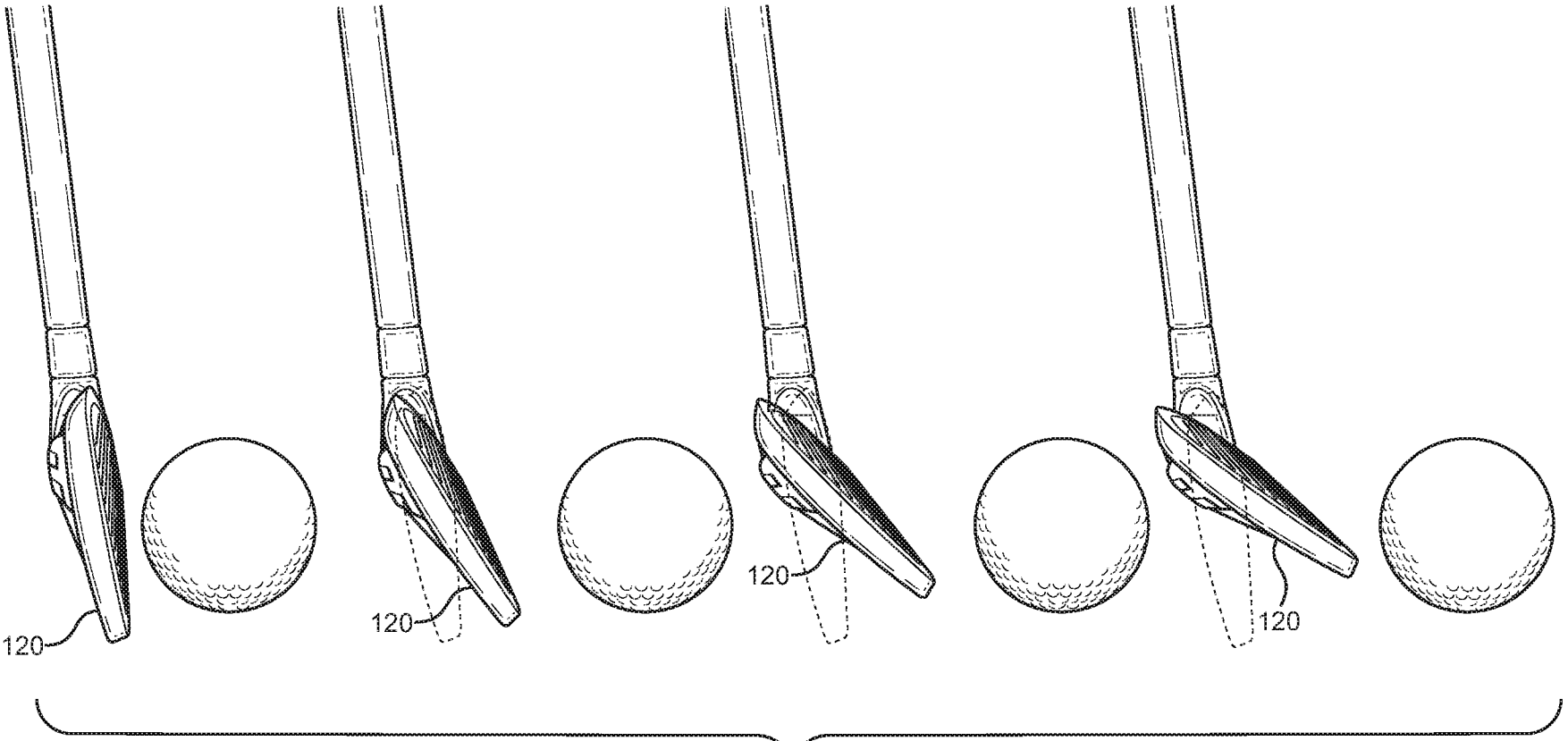
FIG. 7 shows a perspective view of an embodiment of the adjustable golf club illustrating the various angles of the club head.

Referring now to FIGS. 6 and 7, there are shown perspective views of an embodiment of the adjustable golf club in various configurations. In the shown embodiment a selection indicator 600 is disposed on an exterior surface of the club head 120, tangential to the opening of the interior cavity of the club head 120. A series of golf club identifiers 610 are disposed on the shaft 110 tangential to the elongated member. The selection indicator 600 and golf club identifiers 610 can be configured to indicate which golf club is emulated by the selective mating of the first plurality of splines of the elongated member with the second plurality of splines of the club head 120. For example, in the embodiment shown in FIG. 6, the selection indicator 600 is lined up with the number 7, thereby indicating that the adjustable golf club is configured to emulate a "7 iron" golf club where the club head 120 and shaft 110 are in the shown configuration. FIG. 7 demonstrates various club head 120 angles emulating various golf clubs. In the shown embodiment the shaft is in the same position in all views and the club head 120 is shown in various rotational configurations thereby emulating various golf clubs. The shown embodiment is configured to emulate the "irons" set of golf clubs, however, in other embodiments the "woods", "wedges" and/or other golf clubs can also be emulated.

In use the adjustable golf club can be utilized to emulate a variety of standard golf clubs. A quick release button can be depressed thereby retracting the pin disposed on the elongated member. In such a manner the golf club head can be slidably detached from the elongated member and shaft. The golf club head can be rotated along a plane and slidably mated with the elongated member and shaft in a new orientation. The first plurality and second plurality of splines are configured to mate together in a variety of configurations. Each configuration of mating the first and second plurality of splines is configured to emulate a specific golf club. In such a manner a user can avoid carrying a large number of individual and specific golf clubs and can utilize a single adjustable golf club to strike a golf ball at a variety of club head angles thereby emulating a variety of specific golf clubs. In one embodiment, such an individual can also utilize the collar disposed on the shaft to selectively shorten or lengthen the shaft of the adjustable golf club by sliding the first shaft member along the second shaft member. In such an embodiment the individual can customize the length of the shaft to their preferential length.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable golf club, comprising:

a shaft having a first end disposed opposite of a second end;

an elongated member disposed orthogonal to the first end of the shaft;

wherein the elongated member is comprised of a first plurality of splines;

the elongated member configured to be received by a club head;

the club head comprised of an interior channel;

wherein a second plurality of splines is disposed in the interior channel;

the first plurality of splines of the elongated member are configured to mate with the second plurality of splines of the club head;

an angle of the club head is modified by a rotational mating of the first plurality of splines to the second plurality of splines;

the club head connected to the elongated member via a quick release;

the quick release comprised of a button located on the first end of the shaft on a side opposite the elongated member;

a pin attached perpendicularly to the elongated member that is operably connected to the button such that when the button is pressed the pin retracts from the club head proximate the heel allowing the club head to be removed.

2. The adjustable golf club of claim 1, wherein the shaft is further comprised of a first shaft member and a second shaft member.

3. The adjustable golf club of claim 2, wherein an inner diameter of the first shaft member is configured to receive an outer diameter of the second shaft member.

4. The adjustable golf club of claim 3, wherein a collar is further disposed on the first shaft member, configured to reduce the inner diameter of the first shaft member against the outer diameter of the second shaft member, to secure the first shaft member to the second shaft member by friction fit.

5. The adjustable golf club of claim 1, wherein a series of golf club identifiers are disposed on the shaft.

6. The adjustable golf club of claim 1, further comprising a groove located within the interior channel of the club head, wherein the groove is configured to accept the vertical pin.

7. The adjustable golf club of claim 6, wherein the groove is located within the heel portion of the interior channel.

8. The adjustable golf club of claim 6, wherein the groove is located the full three hundred and sixty degrees around the interior channel.

* * * * *